US006688137B1

(12) United States Patent
Gupte

(10) Patent No.: US 6,688,137 B1
(45) **Date of Patent: *Feb. 10, 2004**

(54) PLATE HEAT EXCHANGER WITH A TWO-PHASE FLOW DISTRIBUTOR

(75) Inventor: Neelkanth Shridhar Gupte, Granger, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/278,261

(22) Filed: Oct. 23, 2002

(51) Int. Cl.[7] ..... F25B 39/02; F25B 41/06
(52) U.S. Cl. ..... 62/515; 62/527
(58) Field of Search ..... 62/515, 527, 504, 62/524, 525; 165/115, 117, 159

(56) References Cited

U.S. PATENT DOCUMENTS 5,127,466 A * 7/1992 Ando ..... 165/67
5,327,959 A * 7/1994 Saperstein et al. ..... 165/173
6,606,882 B1 * 8/2003 Gupte ..... 62/504

* cited by examiner

*Primary Examiner*—Chen Wen Jiang
(74) *Attorney, Agent, or Firm*—Wall Marjama & Bilinski LLP

(57) ABSTRACT

A brazed plate heat exchanger has a two-phase refrigerant flow distribution system with improved circulation features. The inlet manifold has parallel pass conduits interconnected by way of a return bend, with the downstream end of the second pass conduit fluidly interconnected with the upstream end of the first pass conduit to complete the circuit. The manifold first pass conduit has a plurality of outlets formed in its wall to accommodate the flow of two-phase refrigerant to refrigerant channels along its length. A nozzle at the upstream end of the first pass conduit provides a relatively high velocity jet stream of refrigerant flow that propels the flow of refrigerant around the circuit so as to prevent stratification.

8 Claims, 2 Drawing Sheets

PLATE HEAT EXCHANGER WITH A TWO-PHASE FLOW DISTRIBUTOR

FIELD OF THE INVENTION

This invention relates generally to air conditioning evaporators and, more particularly, to plate heat exchangers with two-phase refrigerant flow distribution.

BACKGROUND OF THE INVENTION

In the cooling phase of a refrigeration system the heat exchanger referred to as an evaporator receives liquid refrigerant by way of an expansion valve, with the expanding refrigerant then tending to cool the liquid being separately circulated through the evaporator. The fluid to be cooled carries the heat load which the air conditioner is designed to cool, with the evaporator then transferring heat from the heat load to the liquid refrigerant.

One type of heat exchanger used as an evaporator is a brazed plate heat exchanger wherein a plurality of parallel plates define passages, and provision is made for the flow of refrigerant and water in alternate passages so as to effect a heat exchange relationship therebetween. In such a heat exchanger, refrigerant is distributed to alternate channels by way of a manifold extending across on end of the channels. A problem that occurs is that a two-phase refrigerant flow entering the manifold from an expansion valve tends to flow unevenly into the individual channels as it proceeds across the length of the manifold. This is particularly true for larger systems i.e., for example, greater than an 80 ton air conditioner. That is, as the refrigerant flow moves along the manifold, flow rate depletion causes two-phase flow pattern to change, resulting in a maldistribution to the individual channels.

One approach to solve this problem has been to form an orifice at the inlet of each of the refrigerant channels to thereby create a pressure drop and improve the quality of vapor passing into the channels. However, the problem of maldistribution still exists and limits the use of brazed plate heat exchangers to around 100 ton capacity with refrigerants such as R-134a.

Another common approach to solving the problem is to use a liquid-vapor separator to separate the liquid and vapor phases coming from the expansion valve. This can be accomplished by either an internal or external liquid-vapor separator. However, in either case such an addition represents a substantial increase in cost, weight and manufacturing complexity.

It is therefore an object of the present invention to provide an improved method and apparatus for refrigerant distribution in a brazed plate heat exchanger.

Another object of the present invention is the provision for effectively distributing two-phase refrigerant in a brazed plate heat exchanger.

Yet another object of the present invention is the provision for an improved method and apparatus for distributing two-phase flow in a uniform manner to a plurality of channels in a plate heat exchanger.

Still another object of the present invention is the provision for a brazed plate heat exchanger that is economical to manufacture and effective and efficient in use.

These objects and other features and advantages become readily apparent upon reference to the following descriptions when taken in conjunction with appended drawings.

SUMMARY OF THE INVENTION

Briefly, in accordance with one aspect of the invention, a manifold which receives two-phase refrigerant from the expansion valve, is provided with a nozzle which provides a pressure drop and an increase in velocity to propel the two-phase refrigerant flow into the manifold. In this way, the nozzle provides a motive force for a non-stratified flow of the two-phase refrigerant mixture through the manifold to thereby ensure a uniform distribution to the individual channels that are fluidly interconnected to the manifold.

By yet another aspect of the invention, the manifold is a two-pass structure interconnected by a return bend, with the first pass having openings that are fluidly connected to refrigerant channels of the plate heat exchanger, and the second pass is simply provided to return the flow from the return bend to the nozzle at the other, upstream, end of the first pass. The structure of the manifold thus provides a closed circuit such that the refrigerant makes a complete cycle through the manifold to return to the nozzle.

In the drawings as hereinafter described, a preferred embodiment is depicted; however various other modifications and alternate constructions can be made thereto without departing from the true spirt and scope of the invention.

DETAILED DESCRIPTION OF THE INVENTION

Figure 1:
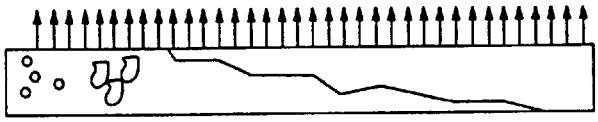
FIG.1 Prior Art
FIG. 1 is a schematic illustration of a typical flow distribution pattern in a prior art brazed plate heat exchanger.

Referring to FIG. 1, there is shown a pattern of refrigerant distribution that results from typical prior art manifold of a brazed heat plate exchanger. It will be seen that at the inlet end of the manifold, the associated channels tend to receive liquid droplets and very little vapor. As the flow proceeds along the length of the manifold, the mixture passing into the channels become more vaporous and less liquid, and when it finally reaches the downstream end of the manifold, the droplets have been depleted and only vapor is passing into the channels. It will therefore be understood that the degree of heat exchange that occurs in the individuals channels will vary substantially, and the overall performance of the heat exchanger will be substantially reduced by this maldistribution of the refrigerant to the individual channels.

Figure 2:
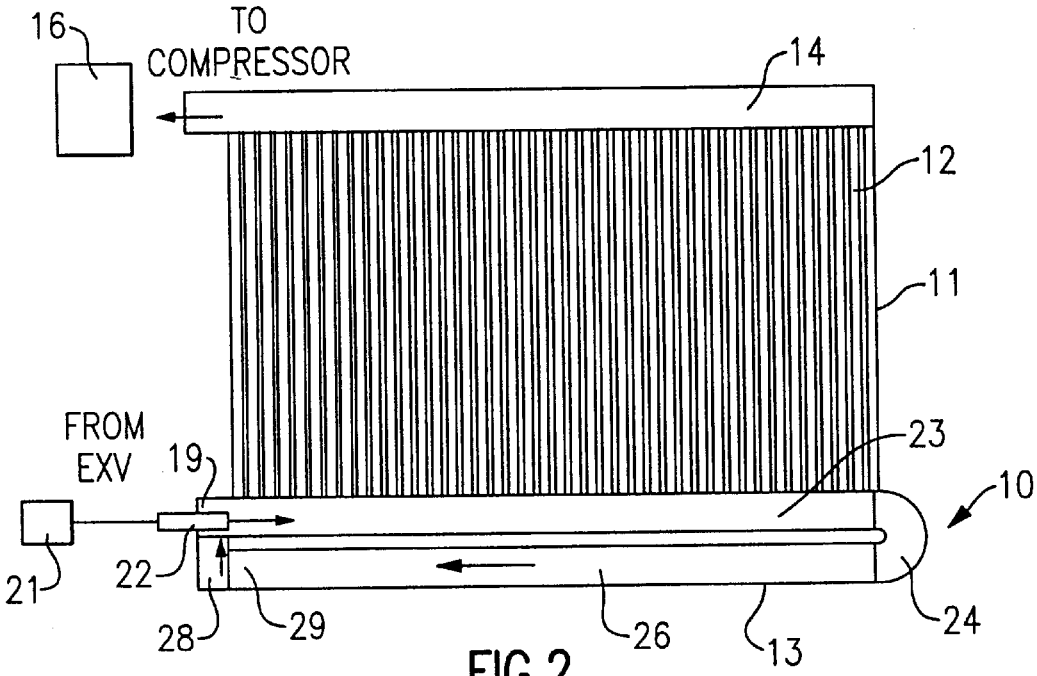
FIG. 2 is a sectional elevational view of plate heat exchanger and manifold with the present invention incorporated therein

Referring to FIG. 2, the invention is shown generally at 10 as applied to a brazed plate heat exchanger 11. The plurality of parallel plates 12 are supported at their ends by inlet and outlet manifolds 13 and 14 as shown. Alternate channels between plates 12 are fluidly interconnected to refrigerant and water distribution systems, respectively, for the circulation of refrigerant and water to be cooled, therethrough. The distribution of water to alternate channels is accomplished in a conventional manner, whereas the distribution of refrigerant is accomplished in accordance with the present invention. Compressor 16 is fluidly attached to the outlet manifold 14 to pump the refrigerant vapors from the heat exchanger 11 for circulation within the system in a conventional manner.

Considering now the distribution of the refrigerant, the manifold 13 is connected at its upstream end 19 to an expansion valve 21. Just inside the header upstream end 19 is a nozzle 22 which acts to increase the velocity of the refrigerant flow into the manifold 13 such that it acts as a jet nozzle to propel the refrigerant flow through the manifold 13. It also assists in maintaining a continuous circular flow of refrigerant around the manifold 13 as will be more fully described hereinafter.

The manifold 13 is comprised of a first pass conduit 23, a second pass conduit 26 disposed parallel thereto, and a return bend 24 which fluidly interconnects the two at their ends as shown. Disposed in the first pass conduit 23 is a plurality of openings or outlets 27 (not shown in FIG. 2 but shown in FIGS. 3 and 4) which fluidly lead to the plurality of channels 12. It is desirable that the two-phase refrigerant flow coming into the upstream end 19 of the first pass conduit 26 is uniformly distributed to the various outlets 27 so that the various channels all receive substantially the same amount of two-phase refrigerant flow at the same condition. This is accomplished, in part, by providing for proper circulation of the flow within the manifold 13 as shown by the arrows. Circulation is enhanced by the completion of the circuit by way of a crossover conduit 28 between the downstream end 29 of the second pass conduit 26 and the nozzle 22 as shown. Thus, because of the momentum of the two-phase flow as caused by the nozzle 22, the jet pump effect draws the refrigerant from the downstream end 29 of the second pass conduit 26 and causes it to reenter the flow stream in the first pass conduit 23. This circular flow pattern thus helps to maintain a relatively uniform mixture of vapor/liquid refrigerant so as to ensure an uniform distribution to the channels 12 as shown in FIG. 3.

Figure 3:
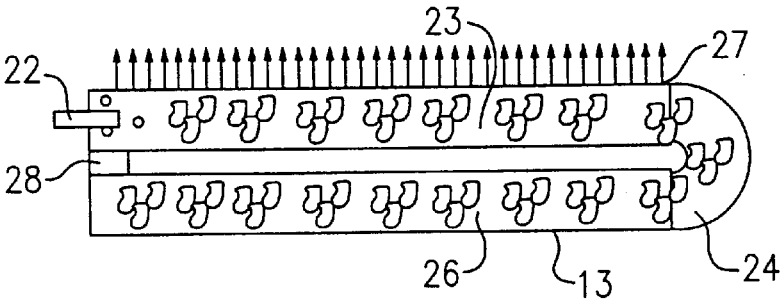
FIG. 3 is a schematic illustration of a flow distribution pattern that results from use of the present invention.

As will be seen in FIGS. 2 and 3, the manifold 13 has been modified by the addition of the return bend 24, the second pass 26 and the crossover conduit 28, all of which are outside and separate from a conventional single pass manifold structure 23. It should be mentioned that these structures can be incorporated as an integral part of the manifold as shown at 31 and 32 in FIGS. 4 and 5, respectively.

Figure 4:
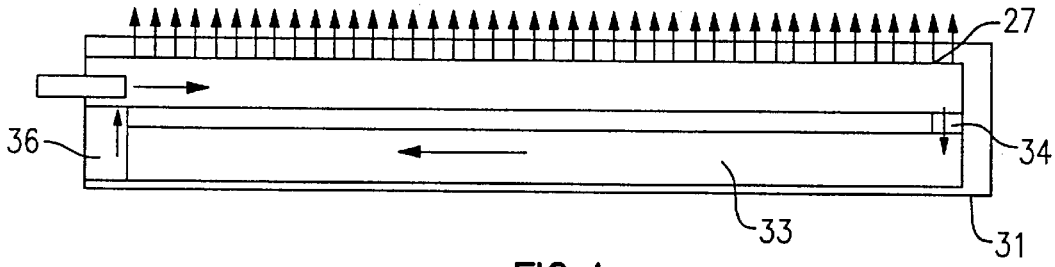
FIG. 4 is a schematic illustration of one embodiment of a manifold in accordance with the present invention.

In FIG. 4, the manifold 31 includes within its confines, a second pass conduit 33 and interconnecting channels 34 and 36 as shown. The structure performs in the same manner as described hereinabove with the two-phase refrigerant mixture being circulated as indicated by the arrows.

Figure 5:
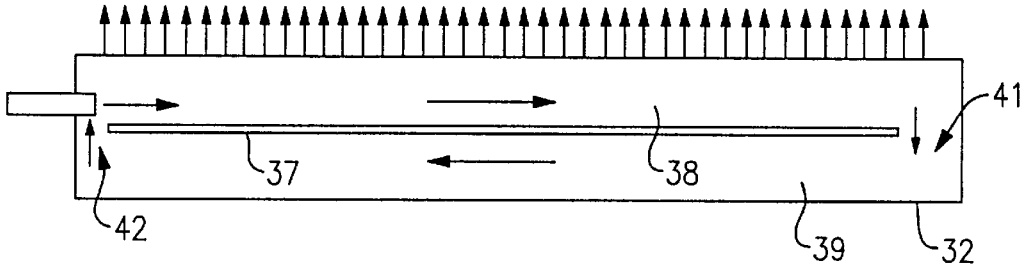
FIG. 5 is a schematic illustration of another embodiment of a manifold in accordance with the present invention.

FIG. 5 shows an alternative embodiment of an integrated manifold 32 wherein plate 37 is mounted within the confines of the manifold 32 to provide a distribution channel 38 and a return channel 39, with openings 41 and 42 interconnecting the channels at their ends. Again, the refrigerant is circulated in the same manner as described hereinabove as indicated by the arrows.

While the present invention has been particularly shown and described with reference to preferred and alternate embodiments as illustrated in the drawings, it will be understood by one skilled in the art that various changes in detail may be effected therein without departing from the spirit and scope of the invention as defined by the claims. For example, even though the invention has been described as a two pass distributor with a nozzle 22 and outlets 27 being in the first upper pass, the nozzle or the outlets could be in the second pass.

We claim:

1. A plate heat exchanger for receiving two-phase refrigerant flow from an expansion valve and delivering refrigerant vapor to a compressor, comprising:

a plurality of parallel plates interconnected at their ends by inlet and outlet manifolds, said plates defining flow channels therebetween for conducting the flow of refrigerant and water, respectively, in alternate water and refrigerant channels, said inlet manifold being disposed at one end of said refrigerant channels for receiving two-phase refrigerant flow from the expansion valve and conducting the flow of two-phase refrigerant to said refrigerant channels, wherein said manifold comprises;

an inlet for receiving two-phase refrigerant flow from said expansion valve;

a first pass conduit for receiving refrigerant from said inlet and further conducting said flow to a return bend for reversal of refrigerant flow direction; and a second pass conduit disposed substantially parallel to said first pass conduit for internally receiving refrigerant flow from said return bend and further wherein at least one of said first and second passes has a plurality of outlet openings formed therein for conducting the flow of refrigerant to said refrigerant channels.

2. A plate heat exchanger as set forth in claim 1 wherein said manifold inlet includes a nozzle for increasing the velocity of said refrigerant flow into said first pass.

3. A plate heat exchanger as set forth in claim 2 and including a conduit interconnecting a downstream end of said second pass conduit to an upstream end of said first pass conduit.

4. A plate heat exchanger as set forth in claim 3 wherein said interconnecting conduit is fluidly connected to said nozzle.

5. A plate heat exchanger as set forth in claim 1 wherein said plurality of outlet openings in is said first pass.

6. A method of distributing two-phase refrigerant flow to a plurality of refrigerant channels in a parallel plate heat exchanger, comprising the steps of:

providing a manifold for receiving two-phase refrigerant flow from an expansion valve and distributing two-phase refrigerant to said refrigerant channels, said manifold having first and second pass conduits, and providing a nozzle in an inlet of said manifold for propelling refrigerant flow from said inlet through said first and second pass conduits.

7. A method as set forth in claim 6 and including the further step of providing a crossover conduit to fluidly interconnect a downstream end of said second pass conduit to an upstream end of said first pass conduit.

8. A method as set forth in claim 6 wherein said step of distributing refrigerant to said refrigerant channels is by way of openings in a surface of said manifold first pass conduit.

* * * * *